United States Patent [19]

Longhouse

[11] 4,213,426

[45] Jul. 22, 1980

[54] SHROUDING FOR ENGINE MOUNTED COOLING FAN

[75] Inventor: Richard E. Longhouse, Rochester, Mich.

[73] Assignee: General Motors Corporation, Detroit, Mich.

[21] Appl. No.: 959,432

[22] Filed: Nov. 9, 1978

[51] Int. Cl.[2] ..... F01P 7/10; F04D 29/40

[52] U.S. Cl. ..... 123/41.49; 165/51; 165/122; 123/41.50; 123/41.63; 415/219 R

[58] Field of Search ..... 123/41.63, 41.66, 41.48, 123/41.49, 41.50, 41.57, 41.65, 198 E, 195 C; 165/51, 135, 122; 415/213 C, 174, 219 R, 182, 185, 170 R

[56] References Cited

U.S. PATENT DOCUMENTS

| | | | |
|---|---|---|---|
| 2,186,837 | 1/1940 | McMahan | 123/41.49 |
| 2,668,523 | 2/1954 | Lamb | 165/51 |
| 3,433,403 | 3/1969 | Gerlitz | 415/219 R |
| 3,635,285 | 1/1972 | Davis | 165/51 |
| 3,794,001 | 2/1974 | Birch | 415/174 |
| 3,799,128 | 3/1974 | Small | 123/41.49 |
| 3,800,866 | 4/1974 | Ireland | 165/51 |
| 3,842,902 | 10/1974 | Poslusny | 165/51 |
| 4,061,188 | 12/1977 | Beck | 415/219 R |
| 4,131,156 | 12/1978 | Crumrine | 165/51 |
| 4,136,735 | 1/1979 | Beck | 123/41.49 |

*Primary Examiner*—Charles J. Myhre
*Assistant Examiner*—Carl Stuart Miller
*Attorney, Agent, or Firm*—Charles R. White

[57] ABSTRACT

Engine cooling fan shrouding comprising a flexible shroud mounted on a stationary component within the engine compartment and a rotating shroud carried by the blade tips of an engine mounted cooling fan. With this arrangement, there is small clearance between the rotating shroud and the flexible shroud so that most of the air drawn in by the fan is through the radiator core for effective cooling of liquids circulated therein. The flexible shroud deflects without damage on engine vibration causing the rotating shroud to contact the flexible shroud.

2 Claims, 4 Drawing Figures

SHROUDING FOR ENGINE MOUNTED COOLING FAN

This invention relates to fan shrouds and more particularly to new and improved shrouding for engine mounted cooling fans to optimize fan performance and to reduce noises generated by such fans.

In many motor vehicles, the engine mounted cooling fan normally revolves in a fixed shroud to draw air through the radiator to cool the engine-heated liquid circulated therethrough. In such constructions, minimized clearance between the external diameter of the fan and the internal diameter of the shroud is desired to increase the cooling efficiency. With small clearance, a restriction is provided that impedes the circumferential circulation of air into the fan which bypasses the radiator so that there is increased axial flow of air into the fan via the radiator. However, with the cooling fan mounted on and driven by the engine, there is substantial relative motion between the fan and the fixed shroud since the fan moves with the engine on engine roll, shake or other vibration. With such relative motion, it has been heretofore necessary to provide substantial peripheral clearances between the external diameter of the fan blades and the internal diameter of the shroud so that the fan blades will not strike and damage the shroud. With these larger clearances, however, fan efficiency is reduced. Also, there are increased noise levels due to the recirculation of air through the peripheral clearance and due to higher fan speed required to increase the air flow through the radiator for sufficient cooling of the liquid.

In contrast to these prior fan shroud constructions, this invention provides for optimized minimum clearance between an engine mounted fan and a fixed shroud. More specifically, this invention provides an annular contoured and first shroud carried by the tips of the blades of an engine mounted fan for rotation therewith. A second annular shroud, separate from the rotatable shroud, is attached to the vehicle radiator or other component fixed relative to the engine. The second shroud has an annular contact member disposed closely adjacent to a smooth and continuous contact surface of the rotatable shroud so that most of the air which is drawn into the engine compartment by the fan passes through the perforated heat exchange surfaces of the radiator. To allow for engine roll, vertical shake, or longitudinal vibrations which occur when the engine powers a vehicle, the second shroud is formed with a yieldable portion or segment that flexes in response to the contact of the annular contact member with the first shroud portion. This yielding or deflection of the first shroud relative to the fan shroud prevents physical damage from occurring by the contact of the rotating fan with the first shroud. With this construction, a smaller clearance can be provided between the shroud elements as compared to prior shroud constructions. Furthermore, with this invention, fan generated noise is significantly reduced and fan performance is significantly improved.

In a first embodiment of this invention, an outer shroud of a suitable plastic material, fixed to the radiator or other support, circumferentially surrounds an inner annular shroud mounted on the tips of the blading of a cooling fan mounted on the vehicle engine. The outer shroud has an annular contact member disposed closely adjacent to the outer peripheral annular surface of the inner shroud. The close proximity of the contact member and the inner shroud provides minimum clearance between the shroud parts restricting air flow from the engine compartment into the fan so that substantial quantities of air do not bypass the perforated heat exchange surfaces of the radiator. Engine vibrations such as engine roll or shade results in direct engagement between the contact and the inner shroud member. The outer shroud has a discrete yieldable portion that deflects to permit this movement without damage to the shroud elements. In second and third embodiments, the contact element of the fixed shroud element is axially aligned with an annular surface of the rotatable fan shroud so that longitudinal vibratory movement of the engine and fan assembly will effect deflection of a flexible part of the fixed shroud. The shrouding in a fourth embodiment is further simplified in form with a fixed shroud generally toroidal in form presenting an annular contact surface axially aligned with the outer annular lip or the rotating fan shroud. The anchored shroud deflects by curling inwardly in response to contact with the fan shroud on predetermined longitudinal movement of the engine and cooling fan relative to the fixed shroud. In all of the embodiments, the clearances between the anchored and flexible shroud with the rotatable shroud is reduced to a point whereby fan cooling and fan generated noises are markedly reduced over prior constructions.

Accordingly, it is a feature, object and advantage of this invention to provide a new and improved shroud arrangement for the engine cooling fan of a vehicle in which a first shroud element anchored to the radiator has an annular contact member disposed closely adjacent to a shroud element mounted at the tips of the blades of a rotatable cooling fan; the first shroud element further has a deflectable portion which flexes on engagement of the contact member and the shroud element to permit the relative movement of the shroud elements while allowing the shroud to effectively restrict the flow of air into the fan.

Another feature, object and advantage of this invention is to significantly reduce the clearance between the rotating engine mounted cooling fan and a stationary but flexible shroud which is attracted to a support fixed relative to the engine so that cooling performance of the fan is improved and resulting fan noises are reduced.

Another feature, object and advantage of this invention is to provide a new and improved flexible and rotating fan shrouding for vehicles allowing the temporary deflection of an anchored shroud component when dynamic movement of the engine mounted fan occurs to permit significant reduction in clearances between the rotating engine mounted cooling fan and the stationary shroud to permit slower and quieter fan operation and more efficient fan operation.

These and other features, objects and advantages of this invention will be more apparent from the following detailed description and drawings in which.

Figure 1:
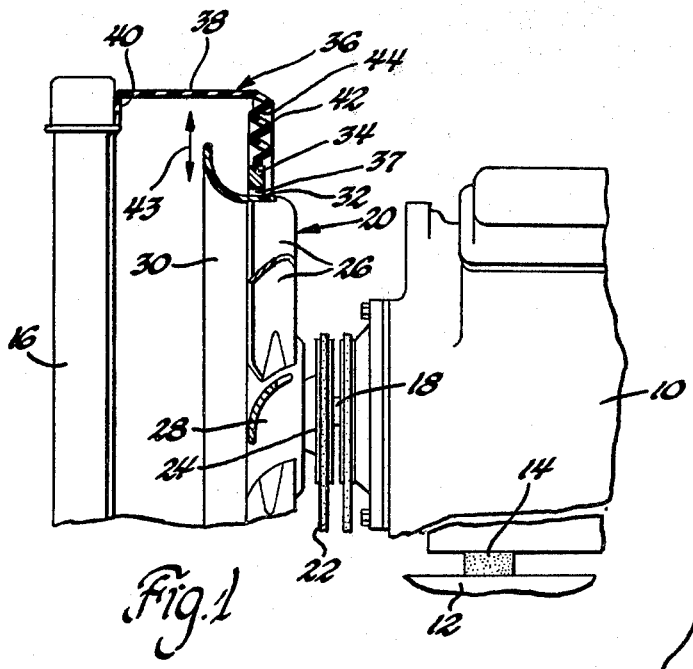
FIG. 1 is a longitudinal elevational view partly in section of an automotive engine, radiator, fan and fan shroud construction illustrating one embodiment of this invention.

Turning now in greater detail to the drawings, there is shown in FIG. 1 a liquid-cooled internal combustion engine 10 resiliently mounted on vehicle frame 12 by elastomeric engine mounting blocks such as block 14. These engine mounting blocks effectively dampen and isolate vibratory energy generated by the engine in powering a vehicle while permitting the engine to vibrate relative to fixed components in the engine compartment. A liquid cooling radiator 16 hydraulically connected to the vehicle engine to dissipate engine generated heat is fixed relative to the vehicle engine being mounted to the vehicle frame or other support forwardly of the engine. Rotatably mounted on a shaft 18 at the forward end of the engine 10 is a cooling fan assembly 20 which is engine driven through a conventional belt 22 and pulley 24.

The fan assembly has a plurality of radial blades 26 which radiate from a centralized hub 28 and which are pitched to draw a stream of cooling air rearwardly through the radiator 16 for discharge over engine 12. The fan assembly 20 further includes an annular bell-mouthed shroud 30 that is integral with or is otherwise securely attached to the outer tips of the blades 26. The fan assembly is preferably formed from a suitable plastic material and the outer periphery of its shroud presents a smooth and continuous cylindrical contact surface 32 which is disposed closely adjacent to a teflon or plastic foam contact ring 34 of an outer shroud assembly 36. The annular clearance 37 between the ring 34 and the fan shroud 30 is so close that it effectively restricts the flow of air therethrough into the fan. The outer shroud assembly includes a rectangular-shaped peripheral wall section 38 having a forward and inwardly extending edge 40 that accommodates mounting tabs or brackets, not shown, for attachment to the engine side of the rectangular radiator 16.

The wall section 38 extends inwardly from the radiator to a plane extending laterally across the shroud 30 of the fan assembly. The inner end of this shroud assembly 36 is closed by a flexible bellows or boot section 42 which comprises a plurality of concentric hinged rings 44 arranged in an accordion-like fashion to provide flexibility in response to any engagement of the contact element 34 with the rotating shroud. The contact element is secured to the inner end of the bellows or boot section by any suitable means.

When there are engine vibrations, such as engine shake indicated by motion direction arrow 43 or engine roll, the smooth cylindrical surface 32 of the rotating fan shroud 30 will engage the annular contact 34 and cause the bellows section 42 to deflect without any damage to the rotating fan shroud 30 or to the flexible outer shroud assembly 36. Even when being radially deflected, the shrouding continues to effectively restrict air flow into the fan through the close clearances between the annular contact ring and the outer surface 32 of the fan shroud. Under such conditions, the fan will draw most of the cooling air through the radiator core for heat exchange and exhaust such air over the air for further engine cooling. When the engine vibrations diminish to such a point that there is no contact with the contact ring 34, the flexible bellows 42 returns to its undeflected position to thereby reposition the contact ring closely adjacent to the contact surface 32 of shroud 30 of the fan assembly.

Figure 2:
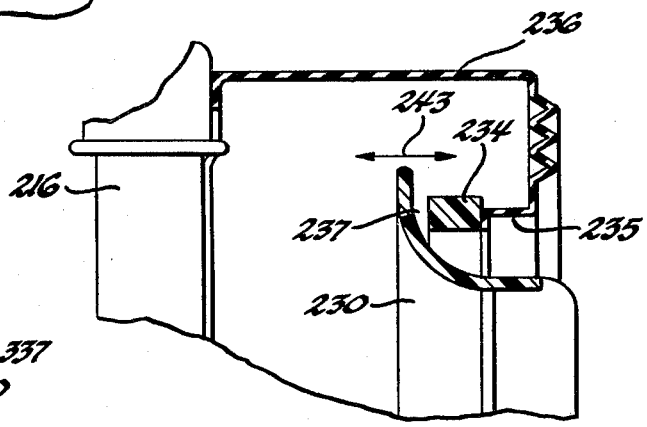
FIG. 2 is a longitudinal elevational view similar to that of FIG. 1 with the engine and fan removed illustrating another embodiment of this invention.

FIG. 2 illustrates an alternate embodiment of this invention in which the annular contact ring 234 is axially mounted on the end of an inwardly directed cylindrical neck 235 of the outer shroud assembly 236. The other components of this embodiment are the same as corresponding components of the FIG. 1 embodiment. The FIG. 2 embodiment, while accommodating vertical vibrations and engine roll as in the FIG. 1 construction, is particularly effective for accommodating longitudinal engine vibrations identified by motion arrow 243. When there are longitudinal vibrations away from the radiator 216, the outer flared portion or bell mouth of the shroud 230 closes the clearance and engages the contact ring 234. This improves cooling fan performance since the air will be drawn through the radiator core for cooling the engine cooling fluids. When the shroud assembly moves forwardly in vibrating, the clearance 237 opens between the contact ring and shroud 230 but the restriction is still such that the shroud assembly is effective for restricting air intake to improve fan performance.

Figure 3:
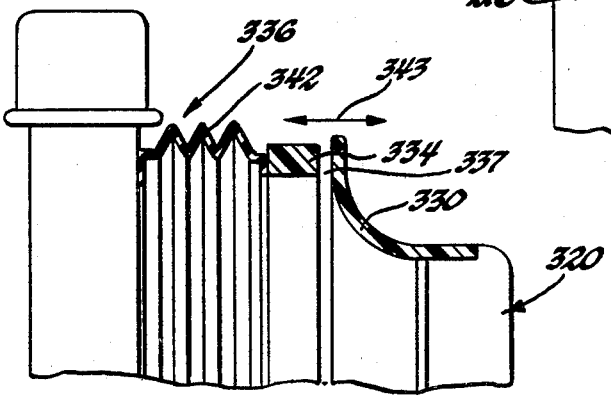
FIGS. 3 and 4 are views similar to the view of FIG. 2 illustrating additional embodiments of this invention.

FIG. 3 is a construction somewhat similar to that of FIG. 2 for improved accommodation of horizontal movement of the fan assembly indicated by arrow 343 and features a smaller radiator mounted shroud assembly identified by the numeral 336. This shroud assembly has an axial bellow section 342 and an axially disposed contact ring 334 disposed in front of the bell mouth of shroud 330 of the fan assembly 320. On forward horizontal vibration, the clearance 337 between the contact 334 and the shroud 330 closed until there is contact with the ring 334. Continued forward movement causes the collapsing deflection of the bellow section 342 without damage to the rotating shroud or the radiator mounted flexible shroud. On rearward oscillation of the fan assembly 320, the clearance between the rotating and flexible shrouds increases but is still effective to restrict the flow of air into the fan assembly so that fan performance is improved.

Figure 4:
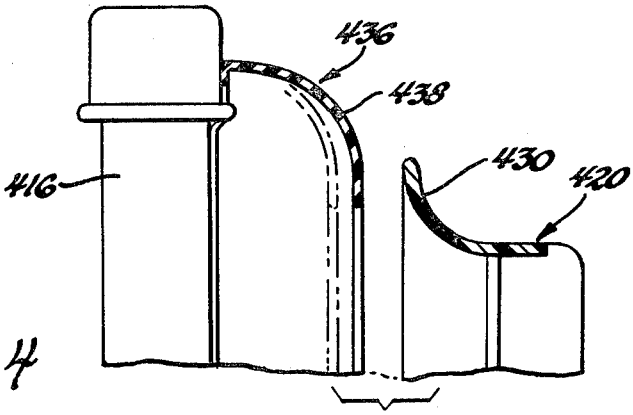

FIG. 4 is an embodiment similar to that of FIG. 3 but is more simplified in that the radiator mounted shroud assembly 436 mounted on radiator 416 in front of fan assembly 420 is a molded flexible ring 438 of thin walled plastic material which is adapted to be contacted by the outer surface of the fan shroud 430 on horizontal outward movement of the fan assembly 420. When this occurs, the clearance between the shroud and the radiator mounted shroud is reduced. When there is sufficient contact the shroud will deflect as indicated in FIG. 4. On this movement, the clearance is closed so that the air will flow through the radiator for engine cooling purposes. Even though the radiator mounted shroud and the fan shroud are subsequently axially separated, it will be appreciated that this device will function to effectively restrict air flow. Also, when there are vertical oscillations and engine roll, the clearance between these shroud elements is sufficiently small to restrict air flow.

The wear on the contact surfaces between the fixed and stationary shrouds should be minimal since contact occurs only during certain dynamic movements. The rotating fan shroud permits this contact to occur without system failure since the shroud is a continuous surface. With the exposed blades of a conventional configuration, contact cannot be tolerated.

While a preferred embodiment of this invention has been shown and described to illustrate the invention, other embodiments will become more apparent to those skilled in the art. Accordingly, the scope of this invention is set forth in the following claims.

I claim:

1. For use with a vehicular engine and radiator, an engine cooling system comprising a fan including a plurality of blades and rotatably mounted on said engine intermediate said engine and said radiator, a rotating shroud secured to the outer tips of said blades and defining an outer periphery, a stationary shroud assembly including a mounting portion attached to said radiator, and a flexible shroud portion extending from said mounting portion into close proximity to a predetermined annular portion of said outer periphery of said rotating shroud, the distal end of said flexible shroud portion being adapted to being intermittently contacted by the adjacent rotating surface of said rotating shroud for temporary deflection of said flexible shroud portion upon dynamic movement of said fan.

2. For use with a vehicular engine and radiator, an engine cooling system comprising a fan including a plurality of blades and rotatably mounted on said engine intermediate said engine and said radiator, a rotating shroud having a substantially cylindrical portion secured to the outer tips of said blades and a bell-mouthed portion extending from said cylindrical portion toward said radiator, the cylindrical and bell-mouthed portions defining an outer periphery, a stationary shroud assembly including a mounting portion attached to said radiator, a flexible shroud portion extending from said mounting portion into close proximity to a predetermined circumferential segment of one of said cylindrical and bell-mouthed portions of said rotating shroud, and an annular contact element secured to the distal end of said flexible shroud portion adapted to being intermittently contacted by the adjacent rotating surface of said rotating shroud for temporary deflection of said flexible shroud portion upon dynamic movement of said fan.

* * * * *